United States Patent [19]

Shawcross

[11] Patent Number: 5,069,601

[45] Date of Patent: Dec. 3, 1991

[54] CEILING FAN WITH REMOVABLE HUB

[75] Inventor: James P. Shawcross, Chesterfield, Mo.

[73] Assignee: Emerson Electric Co., St. Louis, Mo.

[21] Appl. No.: 467,138

[22] Filed: Jan. 18, 1990

[51] Int. Cl.[5] ..... F04D 29/60

[52] U.S. Cl. ..... 417/360; 446/5; 446/204 R; 417/423.14; 417/424.1

[58] Field of Search ..... 417/360, 423.14, 423.15, 417/424.1; 416/5, 204 R

[56] References Cited

U.S. PATENT DOCUMENTS 4,721,480 1/1988 Yung ..... 416/5 X

*Primary Examiner*—Gerald A. Michalsky

*Attorney, Agent, or Firm*—Polster, Leider, Woodruff & Lucchesi

[57] ABSTRACT

A removable elastomeric blade hub and switch housing plate adapter for a ceiling fan to facilitate replacement of the blade hub are disclosed. The fan comprises a motor, a motor shaft, a wire-way tube carried by the motor shaft and a wire termination receptacle connected to the ends of the motor leads carried within the wire-way tube. The elastomeric blade hub has a boss with a bore through the center thereof sized to receive the wire receptacle and the shaft. The hub boss has a set screw on the side thereof to removably secure the blade hub to the shaft. A switch housing adapter plate is removably connected to the wire-way tube beneath the blade hub such that if replacement of the elastomeric hub is required, the switch housing adapter plate and hub may readily be removed from the wire way and from this motor shaft without removing the securement hardware, cutting the leads, or removing the receptacle from the leads.

9 Claims, 2 Drawing Sheets

CEILING FAN WITH REMOVABLE HUB

BACKGROUND OF THE INVENTION

This invention relates to ceiling fans, and, in particular, to a ceiling fan having a removable blade hub and a removable switch housing adapter plate.

In many prior art ceiling fans, an elastomeric hub is used to mount the fan blades onto the rotor shaft thereby to cushion the blades. In certain instances, these elastomeric hubs may fail. While in prior art ceiling fans, the blade hub was typically removably connected to the motor shaft, the switch housing plate adapter was permanently affixed (pressed-in-place) on the wire way tube. Thus, if the elastomeric hub failed or otherwise needed to be to serviced, the complete motor assembly generally needed to be replaced.

SUMMARY OF THE INVENTION

Among the several objects of this invention will be noted the provision of a ceiling fan having a removable switch housing adapter plate which enables replacement of the elastomeric blade hub without removing the securement hardware for attaching the adapter plate, without cutting the lead wires, or without removing the terminal receptacle from the lead wires or otherwise affecting the motor assembly.

Other objects will become apparent to those skilled in the art in light of the following disclosure and accompanying drawings.

In accordance with this invention, generally stated, there is provided a ceiling fan including a motor, a motor shaft, a wire-way tube carried within the motor shaft to carry motor leads from the motor to a switch, an elastomeric (rubber) blade hub for carrying blades removably secured to the motor shaft to rotate with the motor shaft, and a switch housing adapter plate removably connected to the wire-way tube. Lead wires are received within the wire way tube and the lead wires terminate in an electrical receptacle at the free end of the wire way. The blade hub includes a central opening sized to fit over the above-noted receptacle and the shaft. The hub receives a set screw for removably securing the hub to the shaft. A switch housing adapter plate includes a central bore sized to receive the receptacle and the wire-way tube. This switch housing adapter plate is removably secured to the wire-way tube clear of the hub by means of a lock washer and a nut such that in the event the hub must be replaced, the switch housing adapter plate and hub may be readily removed from and replaced on the motor.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
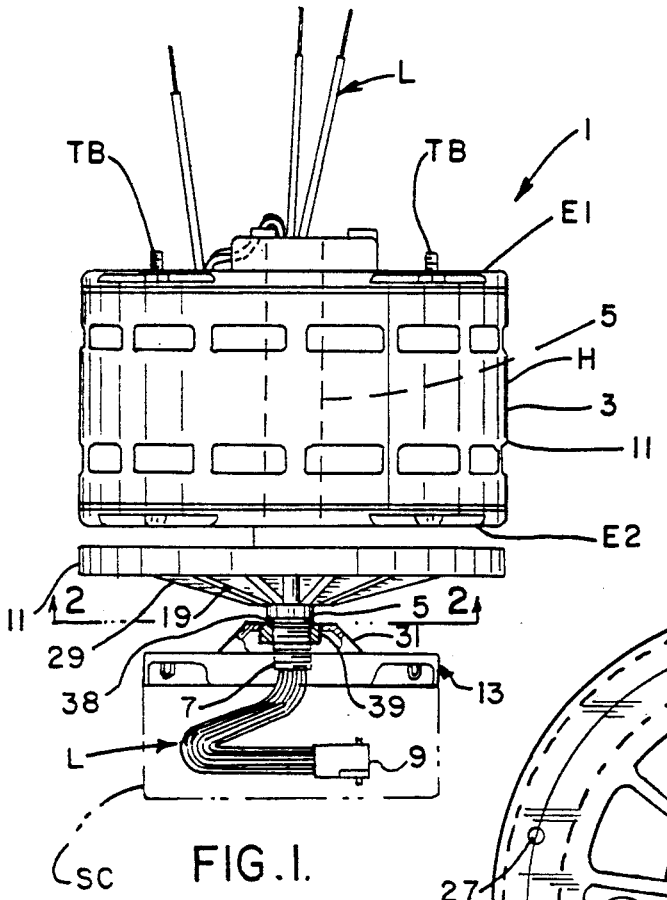
FIG. 1 is a side elevational view of a ceiling fan motor assembly of the present invention.
Figure 2:
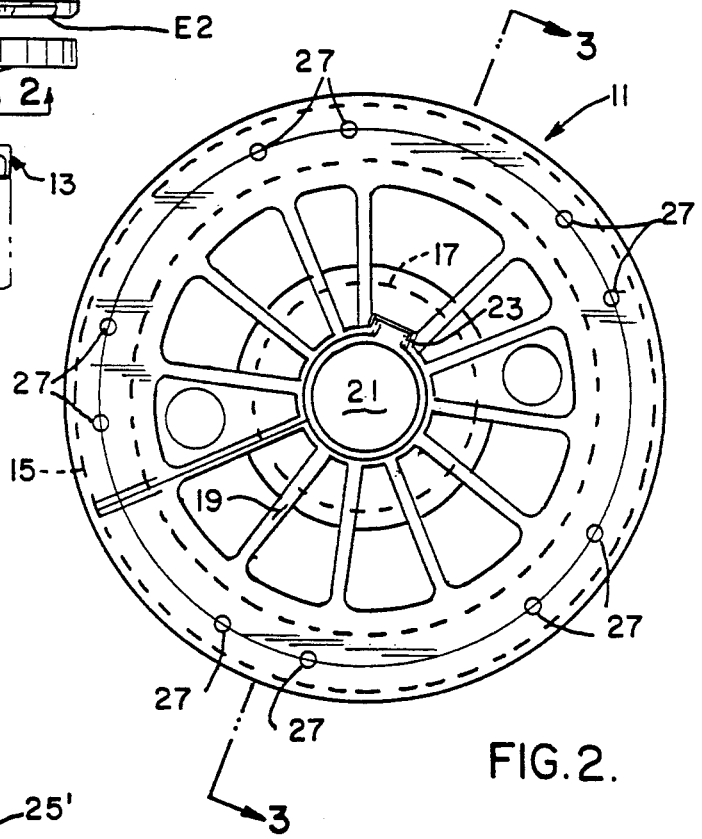
FIG. 2 is a plan view of an elastomeric blade hub taken along line 2—2 of FIG. 1 as it is installed on the motor assembly.

Referring now to FIG. 1, reference numeral 1 indicates one illustrative embodiment of a motor assembly of the present invention for a ceiling fan. Motor assembly 1 includes a motor, as generally indicated at 3, having a housing H enclosing a stator (not shown) and a rotor (also not shown). End shields El and E2 are secured to the ends of housing H by through bolts TB. The rotor has a hollow rotor shaft 5 extending from one end of the motor for rotating with the rotor. The rotor shaft receives a non-rotating wire-way tube 7. Tube 7 extends beyond the end of shaft 5 to carry flexible motor leads or wires L from motor 3 to a lead receptacle 9 so that a fan installer may readily connect the leads L to a switch plug (not shown) within a switch cup SC (as shown in phantom in FIG. 1). As will be explained below, an elastomeric (e.g., rubber) fan blade hub 11 is removably secured to rotor shaft 5 to rotate therewith and a non-rotating switch housing adapter plate 13 is removably connected to wire-way tube 7. In turn, the switch cup SC is removably secured to switch housing adapter plate 13 as will be hereinafter described.

Figure 3:
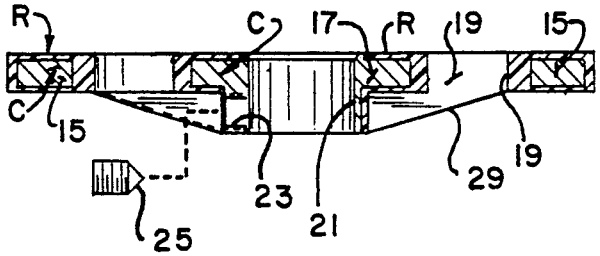
FIG. 3 is a cross sectional view of the blade hub of FIG. 2 taken along line 3—3 of FIG. 2.
Figure 5:
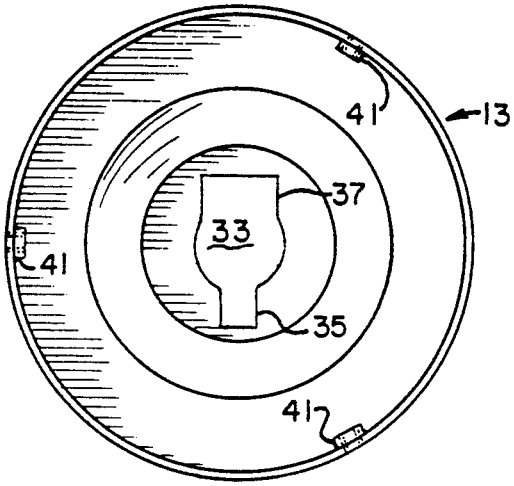
FIGS. 5-8 show plan and side elevational views of two alternate embodiments of a switch housing adapter of the present invention.
Figure 6:
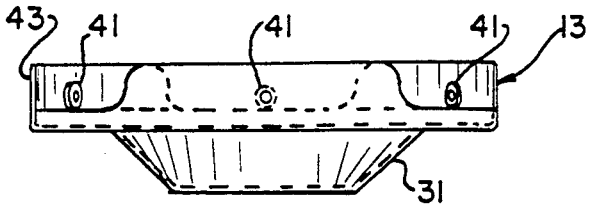
Figure 7:
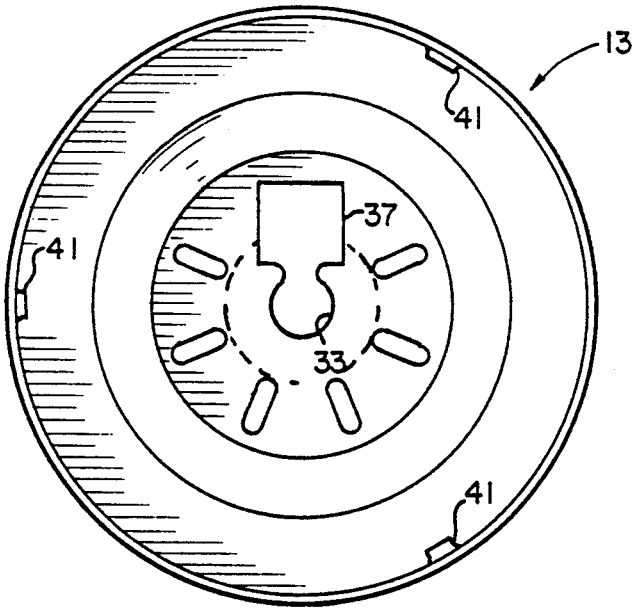
Figure 8:
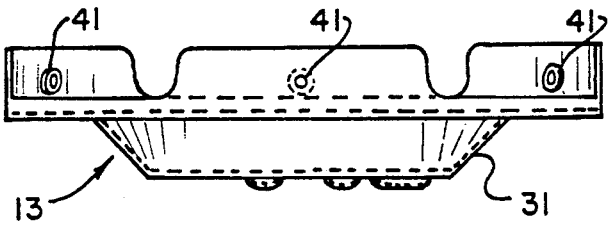

Hub 11 is of composite construction having a metal (preferably an aluminum or a zinc alloy) core C having a suitable elastomeric (rubber) covering R adhered to the core, as shown in FIG. 3. Core C comprises a flat rim 15 and a central hub boss 17 which are separate from one another. Rubber covering R is adhered to rim 15 and hub boss 17 and is provided with a plurality of elastomeric ribs 19 resiliently connecting the rim and the hub boss Hub boss 17 has a central opening 21 sized to receive rotor shaft 5. A threaded opening 23 is provided in hub boss 17 for threadably receiving a set screw 25 which, when tightened, releasably secures hub 11 to rotor shaft 5 for rotation therewith. Rim 15 has a plurality of groups of threaded screw holes 27 for receiving screws (not shown) which secure the fan blade brackets and fan blades (not shown) to the hub. As shown in FIG. 1, the downwardly facing ribs 19 define a frustoconical portion 29 of hub 11. In this manner, elastomeric ribs 19 resiliently mount the fan blades to the hub boss 17 in such manner as to cushion the mounting of the fan blades on the hub.

Figure 4:
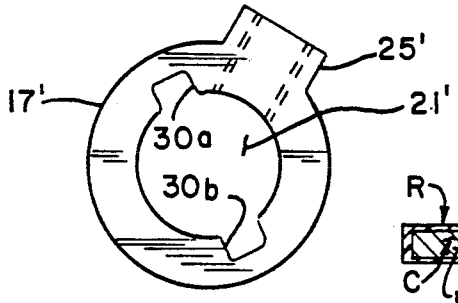
FIG. 4 is an enlarged plan view of an alternate embodiment of the elastomeric blade hub having a central opening configured so that the hub will fit over securing hardware and a wire receptacle connected to the lead wires at the end of a wire-way tube.

As shown in FIG. 4, hub boss 17 may be provided with an alternate central opening 21 having key slots 30*a*, 30*b* for receiving wiring receptacle 9 and hardware for securing switch housing adapter plate 13 to wire-way tube 7 thereby to allow hub 11 to be readily removed from the motor assembly 1 without cutting lead wires L and without removing receptacle 9.

Switch housing adapter plate 13 has a frustoconical top 31 and a center opening 33 in the center thereof which is sized to receive wire-way tube 7 and receptacle 9. Like hub boss central opening 21, plate center opening 33 has a slot 35 and/or a keyhole 37 so that plate 13 may pass over lead receptacle 9 as it is installed on lead wires L and over securement hardware (e.g., lock washer 38 and nut 39 disclosed below) thereby to permit plate 13 and hub 11 to be removed from wire-way tube 7 without cutting lead wires L or without removing receptacle 9 from the lead wires. As best shown in FIG. 1, switch adapter plate 13 is removably connected to wire-way tube 7 by means of lock washer 38 and nut assembly 39. It will be appreciated that in order to enable of removable of plate 13 and hub 11 without cutting lead wires L or without removing receptacle 9, the openings 33 in plate 13 and 21 or 21' in hub 11 must be so sized as to allow washer 38, nut 39 and receptacle 9 to pass therethrough.

As previously mentioned, switch cup SC contains a switch (not shown) is secured to adapter plate 13 by screws (not shown) received in screw holes 41 on adapter wall 43. The switch in the switch cup SC may be readily connected to lead wire L by connecting the switch plug (not shown) to the lead receptacle 9.

In accordance with this invention, the removable manner in which adapter plate 13 is secured to wire way tube 7 by lock washer 38 and nut 39, and the removable manner in which the elastomeric hub 11 is secured to rotor shaft by set screw 25, it is now possible to field repair motor 1 by removing adapter plate 13 and hub 11 and to install a new hub without replacing the entire motor, and without cutting leads L or removing receptacle 9.

Numerous variations, within the scope of the appended claims will be apparent to those skilled in the art in light of the foregoing description and accompanying drawings.

What is claimed is:

1. In a ceiling fan including a motor, a hollow motor shaft driven by the motor, a non-rotating wire-way tube within said motor shaft carrying wires, a receptacle connected to said wires, an elastomeric hub carried by said motor shaft and rotatable therewith, and a switch housing adapter connected to said wire-way tube, wherein the improvement comprises: said hub having an opening for receiving said motor shaft, and means for removably connecting said hub to said motor shaft for permitting of removal of said hub, said adapter having an opening therethrough for receiving said wire-way tube, securement hardware for removably securing said adapter to said wire-way tube, said openings in said hub and in said adapter being configured to fit over said securement hardware and over said receptacle thereby to permit removal of said adaptor and said hub without removing said receptacle from said wires.

2. The improvement of claim 1, wherein said hub includes a central journal having a bore through which said motor shaft extends, said bore constituting said hub opening, said journal carrying means for removably securing said hub to said shaft.

3. The improvement of claim 2, wherein said journal has at least one side bore therethrough, said side bore threadably carrying a said screw so as to removably secure said hub to said shaft such that said hub rotates with said shaft.

4. The improvement of claim 1, wherein said securement hardware for removably securing said switch adapter to said wire-way tube is a lock washer and nut.

5. The improvement of claim 1, wherein said hub opening comprises at least one slot extending from said bore thereby to enable said hub to pass over said securement hardware and over said receptacle.

6. The improvement of claim 1, wherein said opening and said adapter has a slot extending therefrom thereby to enable said adapter to pass over said securement hardware and over said receptacle.

7. A motor assembly for a ceiling fan comprising a motor, a rotatable motor shaft, a stationary wire-way tube within said motor shaft, said wire-way tube routing lead wires from said motor and from a power source to a switch carried by said wire-way tube, an elastomeric blade hub movably secured to said motor shaft intermediate said motor and said switch, and a switch housing adapter plate removably secured to said wire-way tube for at least and in part housing said switch, said hub having an opening therethrough receiving said motor shaft, said switch housing adapter plate having an opening thereto receiving said wire-way tube, securement hardware for removably securing said switch housing adapter plate to said wire-way tube, said openings of said hub and of said switch housing adapter being configured so as to pass over said securement hardware and said receptacle as said switch housing adapter plate and said hub are removed from, said fan thereby to permit removal of said hub from said motor without the necessity of or removing said switch from said lead wires.

8. A motor assembly as set forth in claim 7 wherein said securement hardware comprises a lock washer and a nut for removably securing said switch housing adapter plate to said wire-way tube.

9. A motor assembly as set forth in claim 7 wherein said openings in both said hub and in said switch housing adapter plate have at least one slot extending from said opening thereby enabling said hub and said switch housing adapter plate to pass over said securement hardware and said receptacle.

* * * * *